US007954300B1

(12) United States Patent
Kufner et al.

(10) Patent No.: US 7,954,300 B1
(45) Date of Patent: Jun. 7, 2011

(54) TILE ALIGNMENT AND LEVELING DEVICE

(75) Inventors: Edward A Kufner, Fairfield, IA (US); Michele Volponi, Keokuk, IA (US)

(73) Assignee: Davinci Italia/USA Group, LLC, Fairfield, IA (US)

( * ) Notice: Subject to any disclaimer, the term of this patent is extended or adjusted under 35 U.S.C. 154(b) by 0 days.

(21) Appl. No.: 12/940,645

(22) Filed: Nov. 5, 2010

(51) Int. Cl.
*E04F 21/18* (2006.01)

(52) U.S. Cl. ..... 52/749.11; 52/747.11; 52/126.7; 33/526

(58) Field of Classification Search ..... 52/98, 111, 52/125.4, 126.1, 126.7, 127.1, 127.12, 747.11, 52/749.11; 24/16 PB; 33/526, 527, 533, 33/613; 411/512
See application file for complete search history.

(56) References Cited

U.S. PATENT DOCUMENTS

| | | | | |
|---|---|---|---|---|
| 1,817,447 | A | | 8/1931 | Simpson |
| 3,301,121 | A | | 1/1967 | Newcomer |
| 3,511,001 | A | | 5/1970 | Morgan |
| 3,537,146 | A | | 11/1970 | Caveney |
| 4,286,497 | A | | 9/1981 | Shamah |
| 4,397,124 | A | | 8/1983 | Redman |
| 4,397,125 | A | | 8/1983 | Gussler |
| 4,503,654 | A | | 3/1985 | Cosentino |
| 4,558,544 | A | | 12/1985 | Albrecht |
| 4,865,501 | A | | 9/1989 | Ferris |
| 4,897,899 | A | | 2/1990 | Shely |
| 5,000,890 | A | | 3/1991 | Distefano |
| 5,209,621 | A | | 5/1993 | Burbidge |
| 5,212,920 | A | * | 5/1993 | Tye ..... 52/127.1 |
| 5,263,260 | A | | 11/1993 | Smith |
| 5,288,534 | A | | 2/1994 | Tavshanjian |
| 5,568,785 | A | | 10/1996 | Hazen |
| 5,584,452 | A | | 12/1996 | Koike |
| 5,601,261 | A | | 2/1997 | Koike |
| 5,603,195 | A | | 2/1997 | Cosentino |
| 5,607,256 | A | | 3/1997 | McCleary |
| 5,674,942 | A | | 10/1997 | Hill |
| 5,675,942 | A | | 10/1997 | Crawford |
| 5,702,218 | A | | 12/1997 | Onofrio |
| 5,832,619 | A | | 11/1998 | Volkema, Jr. |
| 5,875,606 | A | * | 3/1999 | Jensen ..... 52/741.41 |
| 5,966,781 | A | | 10/1999 | Geiger |
| 6,000,184 | A | | 12/1999 | Fernandes |
| 6,347,435 | B1 | | 2/2002 | Davignon |
| 6,412,185 | B1 | | 7/2002 | Mills |
| 6,578,239 | B2 | | 6/2003 | Hatch |
| 6,625,951 | B1 | | 9/2003 | McCarthy |
| 6,658,703 | B1 | | 12/2003 | Teagno |

(Continued)

OTHER PUBLICATIONS

Southwest Equipment Management, Inc., Tile Eze, Marble-Plane promotional literature.

*Primary Examiner* — Jeanette E Chapman
*Assistant Examiner* — James J Buckle, Jr.
(74) *Attorney, Agent, or Firm* — Ryan N. Carter

(57) ABSTRACT

A device for aligning and leveling tiles as they are laid in floors, walls, countertops, or the like. The device has a locking assembly and a bottom plate. The components are combined with a shaft that extends from the bottom plate through the locking assembly so that the locking assembly is movable along the length of the shaft. In use, the device is placed between adjacent tiles so that the locking assembly and bottom plate hold adjacent tiles at a desired height as the setting bed dries.

6 Claims, 5 Drawing Sheets

U.S. PATENT DOCUMENTS

| | | | | |
|---|---|---|---|---|
| 6,704,972 | B2 | 3/2004 | Pyle | |
| 7,001,126 | B2 * | 2/2006 | Lesecq | 411/340 |
| 7,257,926 | B1 | 8/2007 | Kirby | |
| 7,520,030 | B2 | 4/2009 | Laporte | |
| 2002/0187020 | A1 | 12/2002 | Julien | |
| 2003/0177613 | A1 | 9/2003 | Caveney | |
| 2006/0185269 | A1 | 8/2006 | Kufner | |
| 2006/0185319 | A1 | 8/2006 | Kufner | |
| 2007/0266531 | A1 | 11/2007 | Krisel | |
| 2008/0236094 | A1 * | 10/2008 | Doda | 52/749.11 |
| 2010/0263304 | A1 | 10/2010 | Torrents I Comas | |

* cited by examiner

TILE ALIGNMENT AND LEVELING DEVICE

BACKGROUND

This invention is directed to the field of laying and leveling tile. More particularly, the invention is directed to a device for aligning and leveling adjacent tiles as they are laid in floors, walls, countertops, or the like.

Tile has become a popular decorative and functional article for use in floors, walls, countertops, and the like. Both professional tile installers and do-it-yourselfers spend a great deal of time aligning and leveling tiles as the tiles are being placed on a substrate's surface. Proper alignment and leveling of each tile is important for a number of reasons. One reason is that if one tile is improperly placed, the error will continue in adjacent tiles such that the installation will be unacceptable and the tiles will have to be replaced and/or ground and polished until the tiles are level or flat. In addition to aesthetic reasons for properly laying tile, a level surface is essential in tile floors so that people do not trip on unevenly laid tiles. Replacing or otherwise correcting errors in tile installation takes time that adds to the total cost of the installation.

Laying and leveling tile can be difficult because many substrates are uneven, such as the ground substrate when laying tile for an outdoor patio. In this case, it can be difficult to raise the low areas of the substrate with mortar or other objects so that all the tiles are level. Further, tiles can shift and sink into mortar as the mortar dries. It has traditionally been necessary to continually monitor newly laid tiles as the mortar dries to ensure that the tiles remain level. Tile installers have used a variety of devices and methods to maintain quality tile installation while completing the installation process as fast as possible. One basic method uses markings on the substrate surface. Marking the installation surface requires the mortar to be carefully applied such that the marks remain visible. Although this technique aids in the alignment of the tiles, it does not keep the tiles level as they are laid in the mortar. Further, the use of this marking technique increases the amount of time required for the installation which results in increased cost.

Another device used for laying and leveling tile is a frame designed to space tiles at an appropriate distance. This type of frame is typically a fixed grid which is designed for a specific tile size. The disadvantage of this type of device is that it is a fixed size which requires a professional installer to carry multiple frames in order to be capable of installing various tile sizes. A further disadvantage of this type of frame is that it is only capable of installing one type of tile at a time.

Another device used to lay and align adjacent tiles is a spacer such as the one described in U.S. Pat. No. 6,625,951 (McCarthy). The spacer disclosed in this patent provides a square edge for properly aligning adjacent tiles at right angles, and a height adjustment means for adjusting the height of the tiles relative to the mortar surface. One problem with this device is that it is difficult to set multiple spacers to the same height which often results in an uneven tile surface. A related problem with this device is that the adjustment means does not allow the height of the tiles to be adjusted after the tile is laid because the height adjustment means is located under the tile after the tile is laid.

Therefore, there is a need for an efficient and inexpensive tile leveling and alignment device.

SUMMARY

The present invention is directed to a tile leveling and alignment device for use in installing tiles on substrates such as floors, walls, countertops, or the like. The invention comprises a locking assembly and a bottom plate combined with a shaft. The shaft extends from the bottom plate through the locking assembly so that the locking assembly is movable along the length of the shaft. A typical first step in laying tile is the application of a setting bed, such as a cement or mortar compound, to the substrate surface. Thereafter, the tiles can be placed in the setting bed. During these steps the bottom plate is positioned in the setting bed. The bottom plate is preferably positioned so that it is in contact with more than one tile. The shaft extends from the bottom plate upward between adjacent tiles and is combined with the locking assembly. The locking assembly is movably combined with the shaft so that after the tiles are laid in the setting bed on top of the bottom plate, the locking assembly is moved toward the tiles until the tiles are between and in contact with the locking assembly and bottom plate. The bottom plate supports the tiles so that adjacent tiles remain level even if the substrate material is not level. In other words, the device keeps the tiles level relative to the adjacent tiles, not relative to the substrate surface. The device holds the tiles at the same height so that corners and/or edges of the adjacent tiles remain level in the setting bed as the setting bed dries and cures.

After the setting bed dries, thereby securing the tiles to the substrate, the shaft is separated from the bottom plate leaving the bottom plate beneath the tiles. The locking assembly and the portion of the shaft above the separation point are removed allowing the locking assembly to be reused in subsequent tile setting and leveling procedures.

One of ordinary skill in the art would understand that a plurality of tile leveling devices can be simultaneously used between different tiles being laid on a substrate so as to level many tiles at the same time.

DETAILED DESCRIPTION

Figure 3:
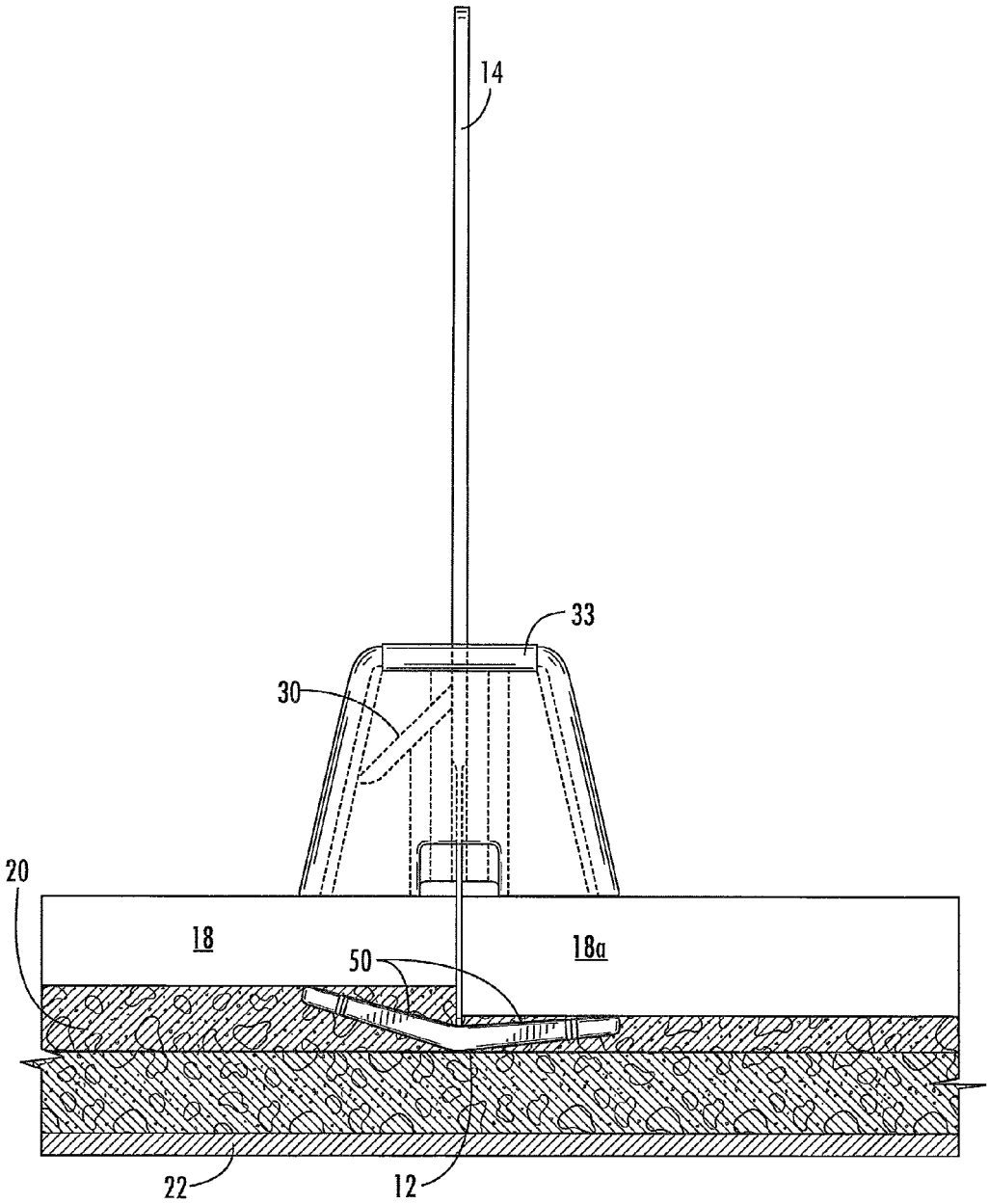
FIG. 3 is a side view of an embodiment showing use between adjacent tiles of different thicknesses.

The present invention is a tile 18 alignment and leveling device. The device can be used to align and level tiles 18 that are being secured to any suitable substrate, including floors, walls, and countertops. It should be noted that words used in this specification such as upper, lower, top, and bottom, are relative to the device as it is shown in FIG. 3 with the locking assembly 33 above the bottom plate 12.

Figure 1:
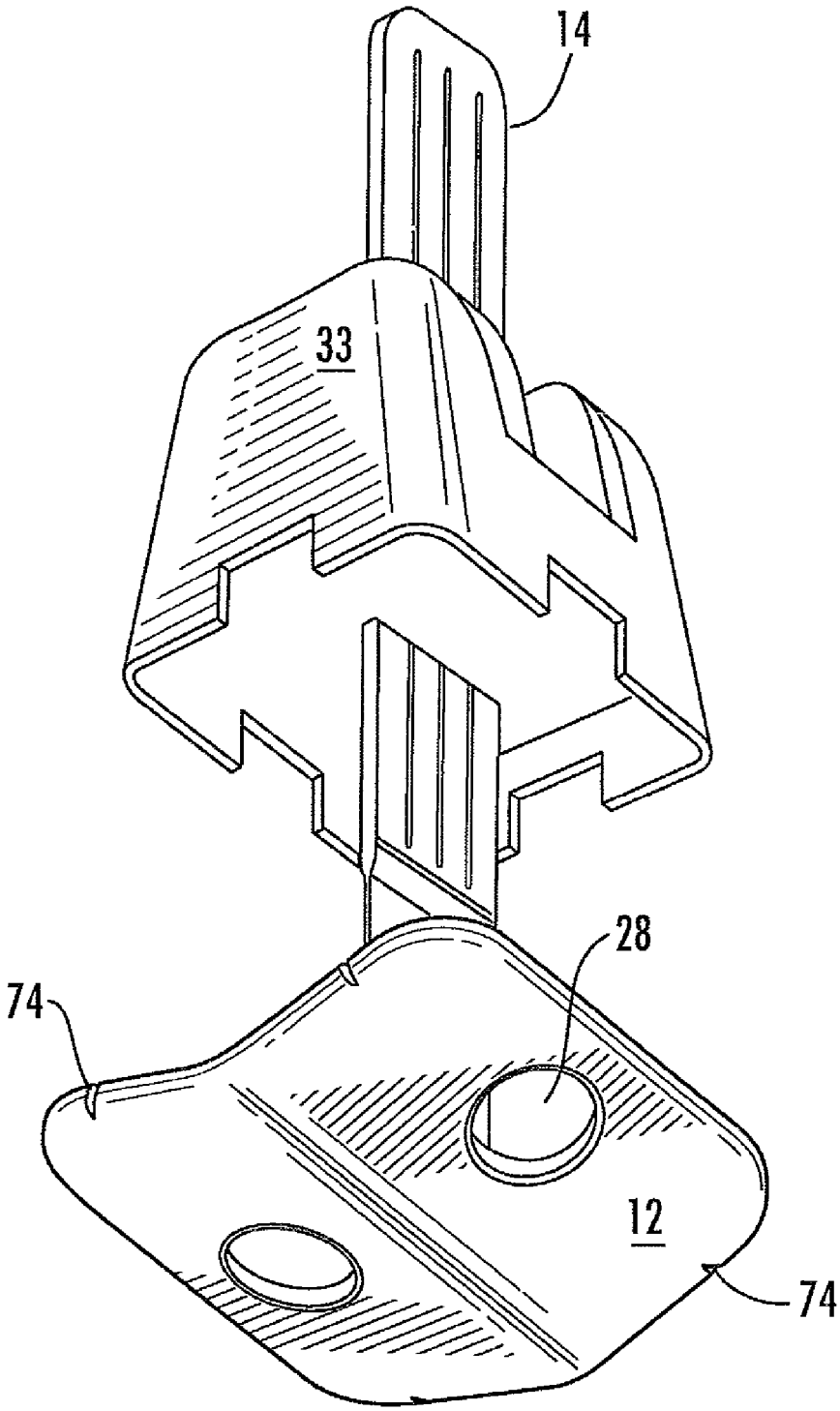
FIG. 1 is a perspective of an embodiment of the device.

As best seen in FIG. 1, the present invention comprises a locking assembly 33 and a bottom plate 12 combined with a shaft 14. The plate 12 can be made from any suitable material, however, it is preferably comprised of plastic or nylon with a metal reinforcing insert embedded inside. The metal insert provides strength and rigidity to the plate 12 that may be needed for leveling heavy tiles 18 or slabs, while the outer plastic (or nylon) portion prevents damage to the tiles 18 and does not rust. The shaft 14 is preferably comprised primarily of flexible nylon, thereby making the shaft 14 semi-rigid.

A typical first step in laying tile 18 is to apply a setting bed 20 such as mortar or cement to the substrate surface 22. After the setting bed 20 is applied, the tiles 18 can be placed in the setting bed 20. In use, the bottom plate 12 of the device is positioned in the setting bed 20 beneath the tiles 18 so that the shaft 14 extends upward between adjacent tiles 18, at joint or corner locations. The shaft 14 extends from the bottom plate 12 upward between the tiles 18 and is combined with the locking assembly 33, which is positioned above the tiles 18. The locking assembly 33 is moved along the shaft 14 toward the tiles 18 until the tiles 18 are in contact with the locking assembly 33 and bottom plate 12 as shown in FIG. 3. The bottom plate 12 and locking assembly 33 hold the tiles 18 at their desired height so that adjacent tiles 18 are level regardless of whether the underlying substrate material 22 is level. In other words, the bottom plate 12 does not need to rest on the substrate 22 in order for the tiles 18 to be level. The bottom plate 12 may even be suspended above the substrate 22 as long as at least a portion of the tile 18 is contacting the setting bed 20 and as long as the tiles 18 are level relative to each other. The plate 12 and locking assembly 33 hold the tiles 18 at the same height so that corners and/or edges of the adjacent tiles 18 remain aligned and level as the setting bed 20 hardens.

Once the tiles 18 are properly positioned, the locking assembly 33 is secured in its place above the tiles 18 and prevented from moving upward along the shaft 14. In some embodiments, the locking assembly 33 comprises at least one locking tongue 30 which, together with the shaft 14, functions like a commercially available "zip tie." In other words, the locking tongue 30 allows the locking assembly 33 to move freely in a first direction (downward) along the length of the shaft 14, but not in a second direction (upward) along the length of the shaft 14. The locking tongue(s) 30 of the locking assembly 33 are angled and adapted to interfere with the shaft 14 to allow movement in only one direction (downward). The locking tongues 30 may comprise a tongue release which enables the user to release the locking tongues 30 from the shaft 14 to allow movement of the locking assembly 33 in the second (upward) direction. In another embodiment, the locking tongue 30 physically penetrates the surface of the shaft 14 to prevent movement in the second (upward) direction.

As seen best in FIG. 1, the bottom plate 12 preferably comprises one or more openings 28. The openings 28 allow the setting bed material 20 to seep through the bottom plate 12 to bond with the portion of the tile 18 directly above the bottom plate 12, which otherwise may not contact much of the setting bed material 20. Further, the seepage helps to ensure that the tiles 18, 18*a* remain level as forces are applied to the bottom plate 12, setting bed material 20, and/or tiles 18 during tightening, leveling, and setting. If the setting bed material 20 was not allowed to seep through the bottom plate 12, the setting bed material 20 could raise the bottom plate 12 as it dried which would consequently affect the level of the tiles 18.

Figure 5:
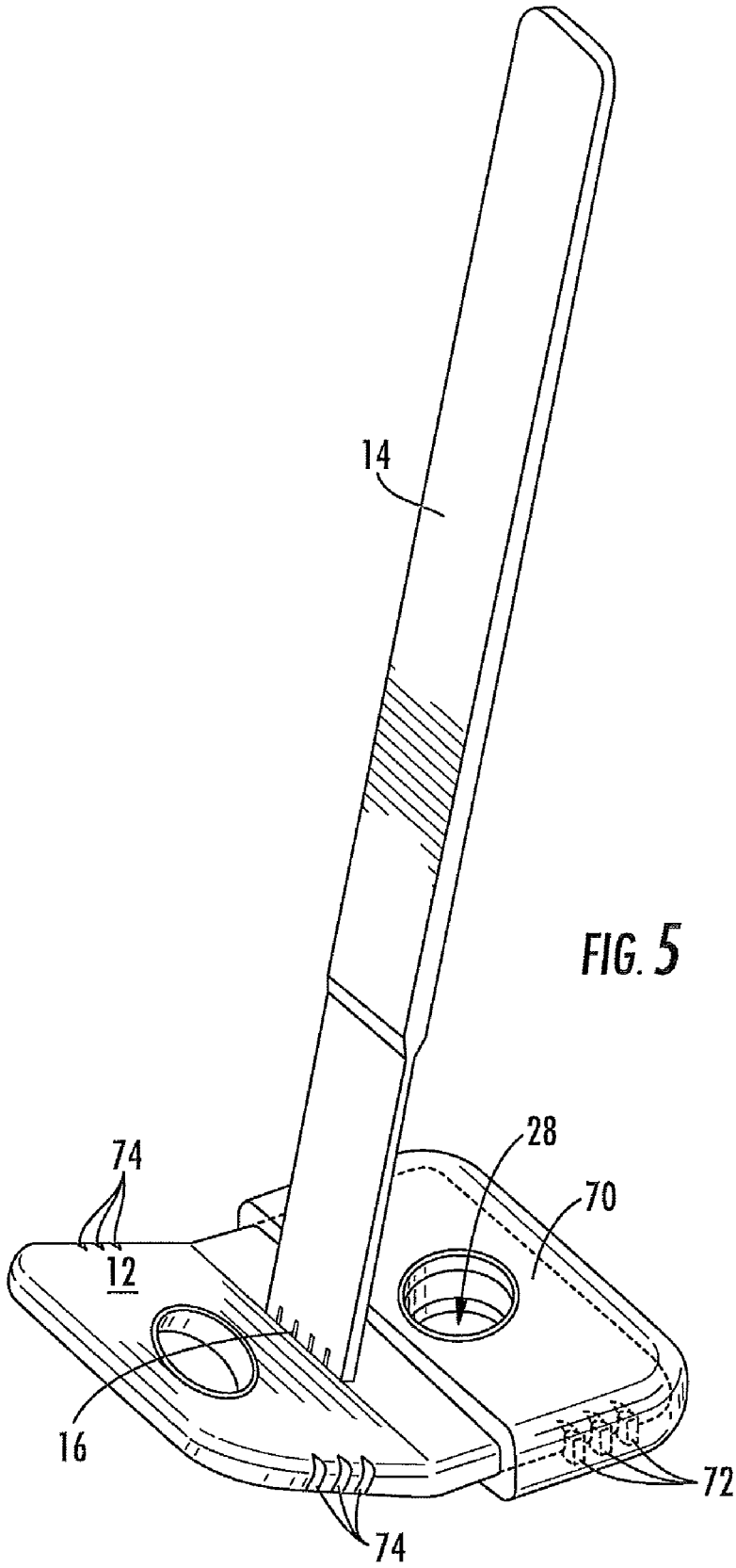
FIG. 5 is a perspective view of the embodiment shown in FIG. 4.

After the setting bed 20 dries and the tiles 18 are secured to the substrate 22, the user removes the portion of the device that is visible above the laid tiles 18, i.e. the shaft 14 and locking assembly 33. In one embodiment, the shaft 14 comprises a separation point 16 near the connection of the shaft 14 and the bottom plate 12 as seen in FIG. 5. The separation point 16 is structurally weaker than the remainder of the shaft 14 so that the user can apply force to the portion of the shaft 14 that extends above the tiles 18 and cause the shaft 14 to break at its separation point 16. The separation point 16 may comprise a single opening which allows the separation point 16 to be structurally weaker and separate when the proper force is applied by the user. Alternatively, the separation point 16 comprises a plurality of micro holes or perforations which allow the separation point 16 to be structurally weaker and separate when the proper force is applied by the user. In one embodiment, the curing process of the setting bed 20 pulls moisture out of the shaft 14 making it more brittle. This makes it easier for the user to break the shaft 14 at the separation point 16. Once separated at the separation point 16, the bottom plate 12 remains below the tiles 18 and is therefore not reusable. The locking assembly 33, however, can be removed from the shaft 14 and reused in subsequent tile 18 laying operations.

Figure 2:
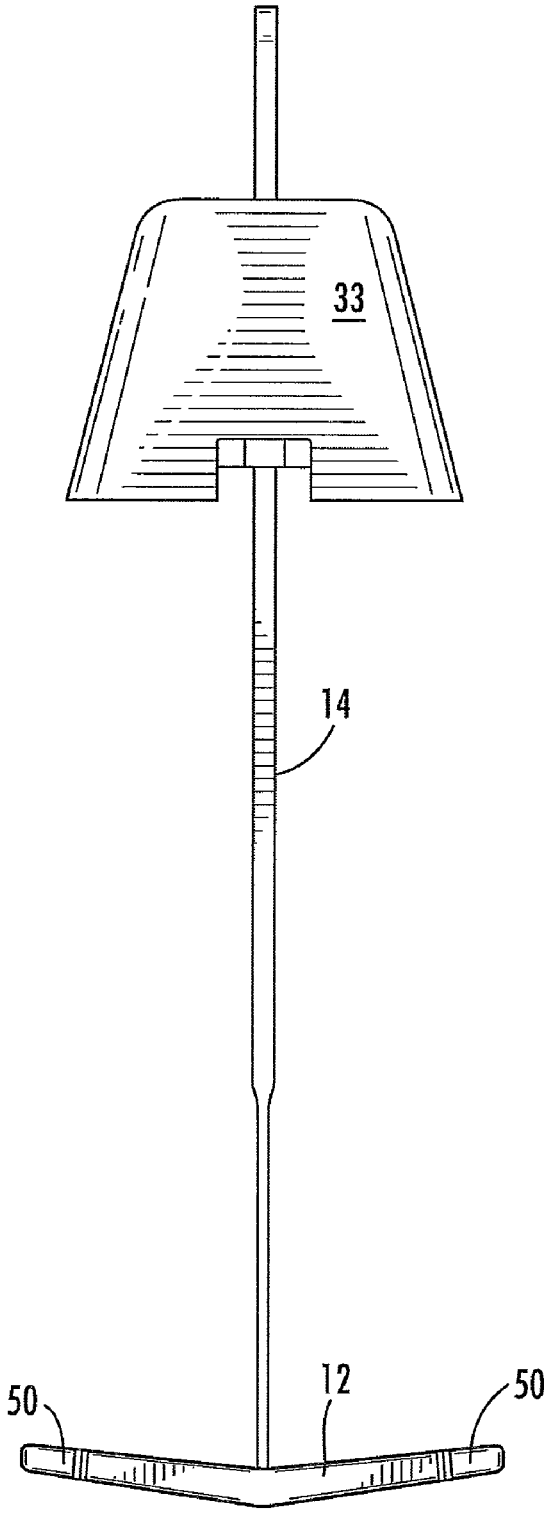
FIG. 2 is a side view of an embodiment of the device.

FIGS. 1-3 shows an embodiment wherein at least a portion of the bottom plate 12 is comprised of a material that has a flexible or spring-like quality, such as a plastic composite. In the embodiment shown, the bottom plate 12 has a "V" shape wherein each leg of the "V" comprises the flexible portion 50 movable between a compressed position and an extended position. Each flexible portion 50 of the bottom plate 12 is biased in its extended position. The angle of each leg of the "V" can vary depending on the conditions. As shown in FIG. 2, the flexible portion 50 of the bottom plate 12 may be tapered so that it is thinner at its outer end to allow the device to be easily inserted under tiles 18.

As seen in FIG. 3, this embodiment is useful in situations where adjacent tiles 18, 18*a* have different thicknesses. The flexible portion 50 of the bottom plate 12 can be compressed under the weight of the thicker (heavier) tile 18*a*, while the flexible or spring-like quality of the bottom plate 12 can remain in its extended position under the thinner (lighter) tile 18 thereby holding the two adjacent tiles 18, 18*a* at the same elevation. In the manner, the tile alignment and leveling device is self-adjusting after it has been placed under the tiles 18, 18*a*.

Figure 4:
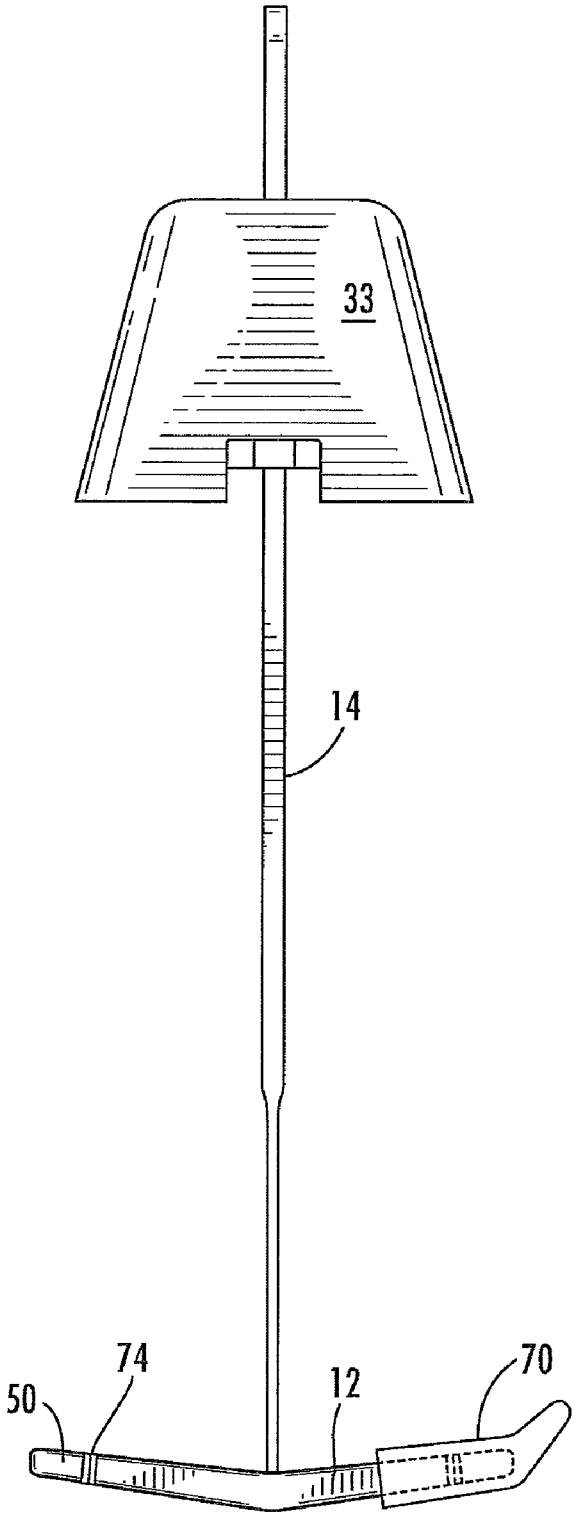
FIG. 4 is a side view of an embodiment having a removable sleeve combined with part of the bottom plate.

FIGS. 4 and 5 show an embodiment comprising a sleeve 70 which is removably combined with the ends of the bottom plate 12. In some embodiments, the sleeve could be made of polypropylene or nylon. The sleeve 70 preferably has an opening that aligns with the opening 28 in the bottom plate 12 to allow the setting bed material 20 to seep through as discussed above. The sleeve 70 may be placed over one of the two flexible portions 50 of the bottom plate 12 to help support thinner tile 18 at the same elevation as the thicker tile 18*a*. For example, with reference to FIG. 3, a sleeve 70 could be placed over the flexible portion 50 that is supporting the thinner tile 18 to hold the thinner tile 18 at higher elevation which helps the top surfaces of the adjacent tiles 18, 18*a* to be level. Alternatively, the sleeve 70 could be placed on one or more of the sides of the bottom plate 12 to raise the height of the device if the substrate surface 22 was low or had a hole.

As shown in FIG. 4, the sleeve 70 may be tapered at its end to help it more easily slide under tiles 18. FIG. 4 also shows an embodiment wherein the end of the sleeve 70 protrudes upward to help support the tile 18 at a higher elevation.

In the embodiment shown in FIG. 5, the sleeve 70 may be retained on the bottom plate 12 by one or more locking members 72 that protrudes from the inside of the sleeve 70 to interlock with corresponding notches or openings 74 in the bottom plate 12. Other securing means include mechanical fasteners, adhesives, and other interference fits.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is as follows:

1. A device for laying and leveling tiles, said device comprising:

a shaft having an upper portion and a lower portion;

a "V" shaped bottom plate combined with the lower portion of the shaft, said bottom plate having a center portion, a top surface, a bottom surface, and two arms that form the "V" shape;

wherein the shaft extends upwardly from the center portion of the top surface of the bottom plate;

wherein each arm of the "V" shaped bottom plate has a flexible portion that extends upwardly and outwardly away from the center portion of the bottom plate, each arm is movable between a compressed position and an extended position; and a locking assembly having an opening adapted to receive the shaft, wherein the locking assembly has at least one locking tongue that interferes with the shaft so that the locking assembly is movable in a first direction along the shaft but not in a second direction along the shaft wherein the shaft further comprises a separation point at its lower end have a plurality of micro holes that make it structurally weaker than the remainder of the shaft to allow the shaft to be separated from the bottom plate.

2. A device for laying and leveling tiles, said device comprising:

a shaft having an upper portion and a lower portion;

a "V" shaped bottom plate combined with the lower portion of the shaft, said bottom plate having a center portion, a top surface, a bottom surface, and two arms that form the "V" shape;

wherein the shaft extends upwardly from the center portion of the top surface of the bottom plate;

wherein each arm of the "V" shaped bottom plate has a flexible portion that extends upwardly and outwardly away from the center portion of the bottom plate, each arm is movable between a compressed position and an extended position; and a locking assembly having an opening adapted to receive the shaft, wherein the locking assembly has at least one locking tongue that interferes with the shaft so that the locking assembly is movable in a first direction along the shaft but not in a second direction along the shaft;

wherein the bottom plate is tapered to be thinner at its edges for easy insertion under tiles.

3. A device for laying and leveling tiles, said device comprising:

a shaft having an upper portion and a lower portion;

a bottom plate combined with the shaft lower portion, wherein the bottom plate has at least two flexible wing portions which are movable between a compressed position and an extended position;

a removable sleeve adapted to be placed over one of the wing portions; and a locking assembly having an opening which is adapted to receive the shaft, said locking assembly having an upper side and a lower side;

wherein the removable sleeve further comprises an inner portion and an outer portion; and a locking member protruding from the removable sleeve inner portion.

4. The device of claim 3 wherein the bottom plate further comprises an opening adapted to receive the locking member to help secure the sleeve to the bottom plate.

5. The device of claim 4 wherein the sleeve has an inner end and an outer end and is tapered at its outer end.

6. The device of claim 5 wherein the outer end of the sleeve protrudes upward to support the tile.

* * * * *